United States Patent [19]

Sanders

[11] 4,258,677

[45] Mar. 31, 1981

[54] ENGINE HEATING DEVICE

[76] Inventor: Nicholas A. Sanders, 109½ E. 2nd St., Hastings, Minn. 55033

[21] Appl. No.: 24,960

[22] Filed: Mar. 29, 1979

[51] Int. Cl.[3] ..... F02M 17/02

[52] U.S. Cl. ..... 123/142.5

[58] Field of Search ..... 123/41.14, 142.5 R; 165/104 S, 51

[56] References Cited

U.S. PATENT DOCUMENTS

| | | | |
|---|---|---|---|
| 1,139,081 | 5/1915 | Stone | 123/122 E |
| 1,765,933 | 6/1930 | Miller | 123/142.5 R |
| 1,837,647 | 12/1931 | Bates | 123/142.5 R |
| 1,892,571 | 12/1932 | Goodwin | 123/142.5 R |
| 1,922,788 | 8/1933 | Wethrall | 123/41.14 |
| 2,234,423 | 3/1941 | Wittmann | 123/142.5 R X |
| 3,062,510 | 11/1962 | Percival | 165/104 S X |
| 3,147,744 | 9/1964 | Percival | 165/104 S X |
| 3,236,220 | 2/1966 | Holmes | 123/142.5 R |
| 4,164,253 | 8/1979 | Skala | 165/104 S X |

*Primary Examiner*—Harry N. Haroian

*Attorney, Agent, or Firm*—Williamson, Bains, Moore & Hansen

[57] ABSTRACT

An apparatus is provided which utilizes the heat of fusion of a storage material to store heat from a vehicle exhaust system for later use in warming the lubricant or cooling fluid of the engine. An elongated canister has a portion of the exhaust system running through it, and that portion is located near the bottom of the canister. Located in the top of the canister is a heat exchanger through which flows engine coolant or lubricant. The remainder of the canister is filled with a heat storage material which may consist of various eutectic salt mixtures or single salts having temperatures of fusion and heats of fusion such that the material is in a liquid state when warmed by the exhaust system and in a solid state at ambient temperatures.

12 Claims, 5 Drawing Figures

ENGINE HEATING DEVICE

BACKGROUND OF THE INVENTION

In colder climates, most vehicle engines, particularly diesels, are extremely hard to start during the winter months. This is due to a combination of factors but is primarily caused by the extreme thickening of lubricants at lower temperatures and the lessened volatility of the fuel mixture.

Heretofore, various types of heating devices have been employed in an attempt to solve winter starting problems. However, these devices have not been altogether satisfactory. Most common is the use of various types of electric heaters which heat either the engine oil or the coolant in an attempt to alleviate starting problems. These solutions, of course, suffer from requiring an external source of energy to run the heating device. Also, United States Patent No. 1,892,571 discloses a device which utilizes a sodium acetate solution in an attempt to help keep the engine coolant warm.

SUMMARY OF THE INVENTION

It is therefore an object of the invention to provide an engine heating device which is efficient in use and inexpensive to manufacture.

Towards this end, an elongated canister having a cylindrical or elliptical cross section is provided and which has a portion of the exhaust system passing through the canister and which is located adjacent the bottom of the canister. The exhaust system tube portion inside the canister has fins located exteriorally thereof and also fins on the inside of the exhaust pipe in order to increase the heat transfer area therein. A multi-pass heat exchanger is located in the upper portion of the canister and also has fins extending therefrom. The remainder of the canister is filled with a single salt or a eutectic mixture of salts or some other phase change material such that the substance will be in a liquid state when heated and thereby melted by the hot exhaust gases flowing through the exhaust pipe and will be in a solid state when the material is cooled to ambient temperatures. The design locating the exhaust conduit adjacent to the bottom of the canister is important in that it allows the use of free convection effects during the heating cycle which provides for more efficient operation. Such phase change materials as used herein typically have much lower heat transfer coefficients in the solid state than in the liquid state and such that as heat is extracted the storage material will solidify. It is thus desired to have fins extending a substantial distance from the heat exchanger tubes into the heat storage material to increase the heat transfer area. A fluid circulated through the engine such as an engine coolant or lubricant is then circulated through the heat exchanger by means of a pump when it is desired to warm fluid. Since engine lubricants also perform a cooling function, hereinafter engine coolants, lubricants and any other fluid circulated through the engine will be collectively referred to as "coolants." Solenoid valves are placed at the inlet and outlet of the heat exchanger adjacent the canister, so that the valves may be closed to prevent the flow of fluid through the heat exchanger during the heating up mode and to prevent convective heat loss during the storage mode.

Due to the high temperature presented by the exhaust system and which will generally heat the storage material to a corresponding temperature, it may be desirable to impose an intermediate working fluid between the coolant and the canister of the instant invention. There, a thermally stable intermediate fluid such as a thermally stable non-lubricating oil is circulated through the heat exchanger of the canister and thence to a more conventional heat exchanger wherein the heat picked up in the canister is transferred to the coolant.

Not only is starting improved by warming of lubricants in the engine in general, but easier starting is also obtained by the heating of the fuel that accompanies operation of the device. In heating the coolant (and in turn the engine itself), the fuel injectors or carburetor are heated which in turn heat the fuel flowing therethrough, thereby increasing the volatility of the fuel. This increases the ease of starting. It is also possible to save the amount of fuel which is normally used to run a diesel truck overnight in climates where the temperature is below freezing, since this continuous running is normally necessary in such climates. Normally, trucks require from five to ten gallons per night to keep them running, and this amount of fuel totalled over the winter and over the number of trucks in colder climates can be a significant amount.

These and other objects of my invention will become readily apparent as the following description is read in conjunction with the accompanying drawings wherein like reference numerals are used to refer to the several views.

DESCRIPTION OF THE DRAWING FIGURES

DESCRIPTION OF THE PREFERRED EMBODIMENT

Figure 1:
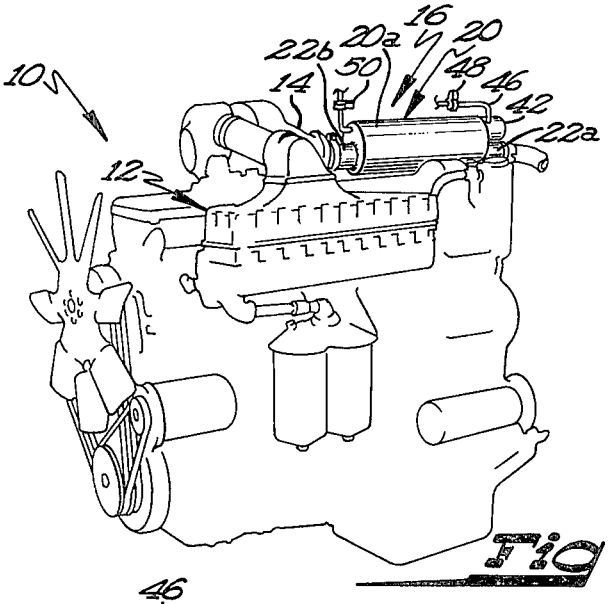
FIG. 1 is a perspective view showing the instant invention mounted to a diesel engine.

A vehicle engine, generally 10, of the gasoline or diesel type has an exhaust manifold 12 attached thereto and a head pipe 14 attached to exhaust manifold 12. The engine heating device 16 of the instant invention is attached to head pipe 14 preferably as close to exhaust manifold 12 as possible and, the further upstream device 16 is located, the more heat will be available in the exhaust for storage and later use. Device 16 may be attached to the exhaust system by welding or by conventional muffler type clamps as shown in FIG. 1. The particular method of attachment used is not important and does not form part of the instant invention.

Heating device 16 is comprised mainly of an inner canister 18 which is formed of a generally cylindrical or elliptical shell 18 which is in turn comprised of a tubular member **18*a* and corresponding end plates 18*b* and 18*c* affixed at the respective ends of shell 18*a*. Shell 18 is preferably formed of a corrosion-resistant material such as 316 stainless; however, other materials may be used. End plates 18*b* and 18*c* are affixed to tubular member 18*a* by means of welding or the like. Located about the outside of inner shell 18 is insulation 19 which may be of the aluminum foil fiberglass laminate commonly used in cryogenic applications although any highly effective insulating material may be used. An outer shell 20 is located about the outside of inner shell 18 and insulation 19 and conforms generally in shape to inner shell 18. Outer shell 20 is also comprised of a tubular member 20***a* and end plates 20*b* and 20*c* which are formed in the same fashion as the corresponding parts of the inner shell.

While the aforementioned insulation is used in cryogenic applications, care must be taken that such insulation is also capable of withstanding the high temperatures involved in the instant application. Also, for best results, a vacuum should be drawn on the cavity between inner and outer shells 18 and 20. This, in conjunction with the insulation, forms a highly effective heat barrier. If other insulation not requiring a vacuum is utilized the outer shell 20 may be deleted.

Figure 3:
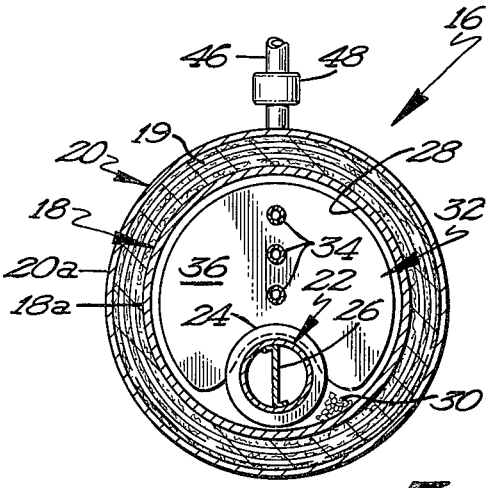
FIG. 3 is a sectional view taken along lines 3—3 of FIG. 2.
Figure 2:
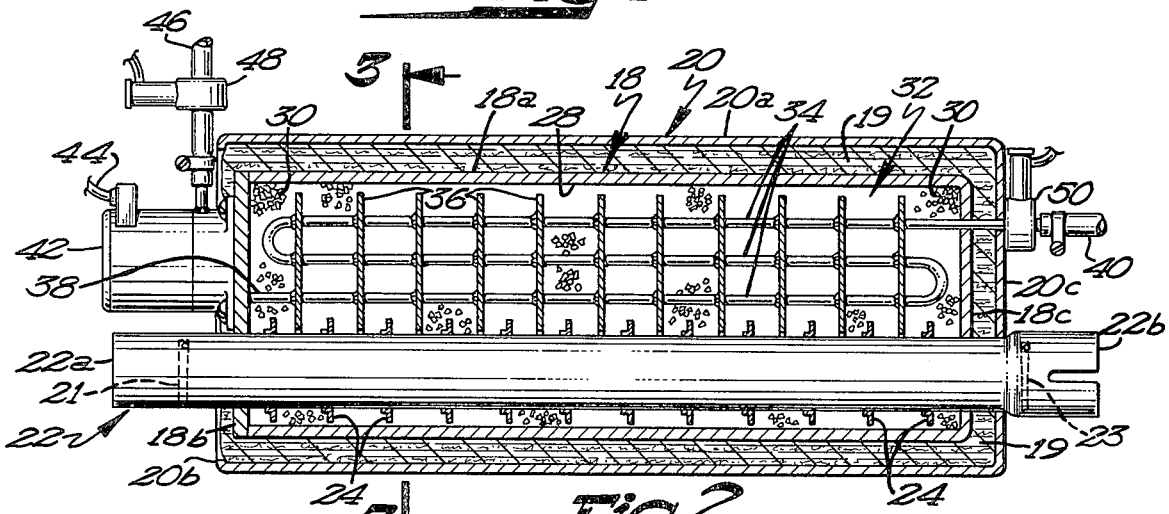
FIG. 2 is a longitudinal cross section of the device.

An exhaust gas conduit 22 is located in the lower portion of the cavity 28 which is defined by inner shell 18. Conduit 22 has an intake end 22*b* and exhaust end 22*a* and passes through shell end plates 20*c*, 18*c*, 18*b* and 20*b* in that order as shown in FIG. 2. Conduit 22 is sealed to the aforementioned endwalls by means of welding or the like so as to maintain integrity of the cavity 28. A series of fins 24 is provided on the outside surface of exhaust conduit 22 for increasing the heat transfer surface thereon. FIG. 3 also shows that internal fins 26 may be provided to further increase the ability of the exhaust conduit 22 so as to absorb heat from the exhaust gases. Of course, more such fins may be added if so desired, although obviously a compromise must be provided between the increased heat transfer ability provided by such fins and the increased back pressure in the exhaust system which such fins would also tend to cause.

It is also desirable to isolate the exhaust conduit 22 from the rest of the exhaust system during the storage mode to prevent heat conduction and convection through the air contained in the exhaust system. Toward this end, air flapper valves 21 and 23 are located adjacent ends 22*a* and 22*b* respectively. While the particular structure of these devices does not form part of the instant invention, any valve that will open upon the operation of the engine and flow through the exhaust but which closes upon the stopping of the engine and exhaust flow will be suitable.

A coolant heat exchanger 32 is provided in the upper portion of canister 18. Heat exchanger 32 may be a multi-pass unit having an intake end 38 adjacent to endwall 18*b* and an outlet end 40 passing through endwall 18*c*. A number of fins 36 are provided and extend significantly outwardly from tubing 34 and into the salt 30 region as well as between fins 24 of exhaust conduit 22. The intake 38 of heat exchanger 32 is connected to pump 42 which may be mounted as shown on endwall 20*b* or which may be mounted separately. Of course, if the pump is not of the self-priming type, it will be necessary to mount it at a level suitable so that the rest of the fluid in the system will cause the priming to take place properly. Power to the pump is provided by an electrical source 44 which may be manual or automatic as more fully described hereinafter.

Heat exchanger 32 is held in place in canister 18 only by the places where intake 38 and outlet pass through the respective endwalls to which they are affixed and sealed. The remainder of cavity 28 is filled with a salt or a eutectic salt mixture or some other phase change material such that the phase change takes place at an appropriate temperature. The preferred embodiment of the instant invention utilizes lithium nitrate as the heat storage medium salt 30. Another advantageous storage medium is a mixture of potassium hydroxide and lithium hydroxide. Since salts expand during melting, it is desirable to leave a space for expansion in canister 18 when the device is filled with the salt 30. Solenoid valves 48 and 50 are attached to the inlet 46 of pump 42 and the outlet 40 of heat exchanger 32 respectively. The purpose of these valves is to prevent heat conduction and convection through the coolant while the device is in the storage mode and to prevent the circulation of coolant through the heat exchanger 32 while the device is in the heating up mode and the engine is running.

Figure 5:
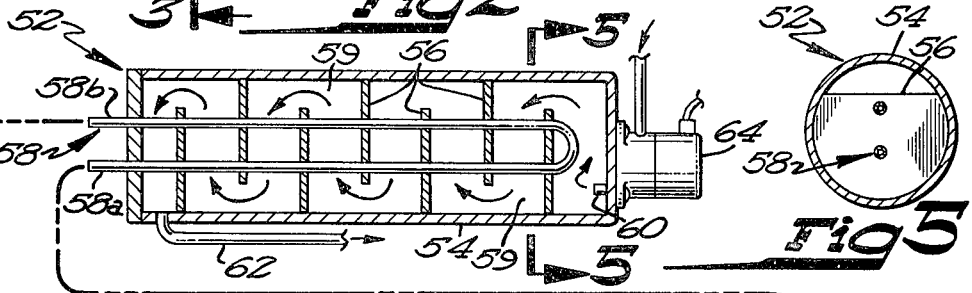
FIG. 5 is a sectional view taken along lines 5—5 of FIG. 4.
Figure 4:
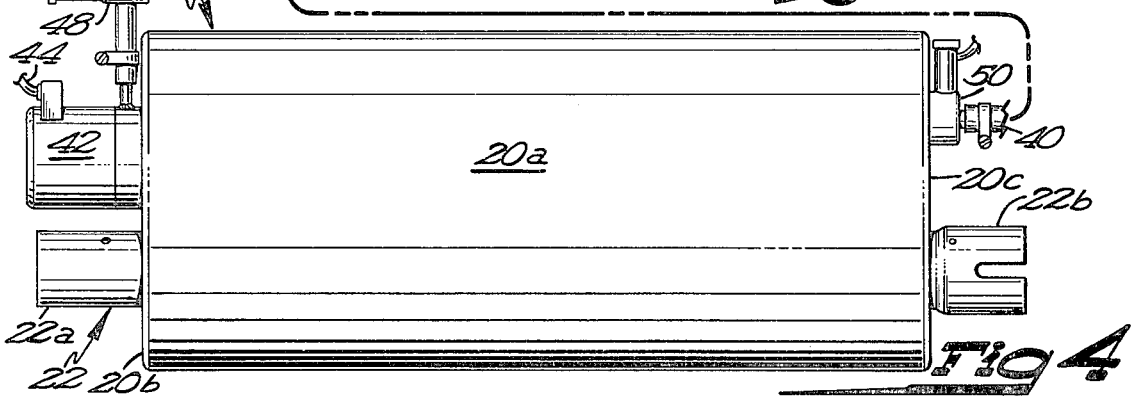
FIG. 4 is a plan view of a modification of the instant invention.

Since the temperature of the exhaust gases passing through conduit 22 (and accordingly the temperature of material 30) is in the neighborhood of 300 to 350 degrees celsius, it may be desirable to utilize an intermediate heat exchange fluid and heat exchanger. This modification will be necessary when the coolant (engine coolant or lubricant) will be damaged by direct exposure to temperatures on the order of 300°–350° celsius. Toward this end, an intermediate heat exchanger 52, which may be of any known conventional type, is formed of a shell 54 having baffles 56 located therein as shown in FIGS. 4 and 5. An intermediate fluid is circulated through intermediate fluid side 58 of secondary heat exchanger 52 and through heat exchanger 32 of the instant invention. This fluid may be a thermally stable non-lubricating oil or any other fluid capable of withstanding the high temperatures of the liquid phase change material. In turn, the coolant is circulated through the coolant side 59 of secondary heat exchanger 52 in the path, as shown by the arrows in FIG. 4. Fluid enters shell 54 of secondary heat exchanger 52 by means of entrance port 60 and exits through tube 62. A pump 64 may be utilized to assist in the circulation of the coolant.

In a further variation of the instant invention shown in FIGS. 4 and 5 the "coolant" to be heated is the engine lubricant which will be run through coolant side 59 of secondary heat exchanger 52. The intermediate fluid may then be the actual engine coolant (water-antifreeze mixture) which gives in effect a two-stage heating system.

OPERATION OF THE INVENTION

In operation, the first time the device is utilized a "coldstart" will be necessary. In this sequence, the engine is started and operated in the normal manner. Exhaust gases passing through exhaust conduit 22 will heat conduit 22 and attached fins 24 thereon. The heat storage medium 30 will thence initially liquefy in the regions adjacent conduit 22 and fins 24, thereby setting up free convection cells. As the engine is operated, eventually all of the heat storage medium 30 will be melted by the hot exhaust gases passing through conduit 22 and a great deal of energy will be stored during the phase change as the heat of fusion is quite substantial in comparison to the amount of heat required to raise or lower the temperature in any given single phase. During this time, the solenoid valves 48 and 50 are closed and no coolant is circulated through heat exchanger 32. During this heating up mode, solenoid valves 48 and 50 also are arranged to act as check valves in that coolant trapped in heat exchanger 32 will be vaporized and allowed to expand only outwardly through valves 48 and 50.

When the engine is shut off, valves 48 and 50 remain closed and the device then acts only to store the heat in the latent heat of fusion and sensible heat capacity of the material 30. This is the storage mode.

When it is desired to warm the engine for later use, pump 42 is actuated and solenoid valves 48 and 50 are opened allowing the coolant to circulate through heat exchanger 32. Of course, initially heat will be drawn away from the storage medium 30 adjacent the tubing 34. As that material gives up the heat it contains, material 30 adjacent tubing 34 will tend to solidify. Thus fins 36 tend to extend and expand the area of heat transfer. Eventually, depending on the thermal capacity of the device 16 and of the engine 10, the engine coolant and the engine itself will be warmed sufficiently that it may be started with relative ease.

Of course, several refinements may be used with the instant device to assure more efficient operation. A thermostat may be installed to cut out the operation of pump 42 and close solenoid valves 48 and 50 when the engine has assumed normal operating temperature so that the heating device 16 does not transfer heat to the cooling system when it does not need it. Also the thermostat may be set so that the pump 42 and solenoid valves 48 and 50 will not open and operate unless the salts have reached a minimum temperature. This is useful when the vehicle has been sitting for a long time such that even with a well insulated device, the heat has been dissipated to the extent that the device will not perform any meaningful heating function. Of course, as may be appreciated from the size, shape and location of the device, the device may be modified to act additionally as a muffler so that no extra space is required for installation of the invention.

It is contemplated that various changes and modifications may be made to the engine heating device without departing from the spirit or scope of my invention as defined by the following claims.

What is claimed is that:

1. An Engine Heating Device for use with an internal combustion engine having an exhaust system and an engine coolant system, the device being used to warm said engine prior to starting the comprising:

a fluid-tight elongated canister having first and second ends and a cavity therein;

an exhaust gas conduit for carrying engine exhaust gasses during engine operation passing through said cavity of said canister from said first end to said second end, said conduit having an inlet end and an outlet end and being connectable to said exhaust system;

means for thermally isolating said exhaust gas conduit from said exhaust system when exhaust gasses are not flowing;

a cooling fluid conduit having an inlet and an outlet, said cooling conduit passing through said cavity and being connectable to said engine coolant system;

means for selectively thermally isolating said cooling fluid conduit;

means for circulating coolant through said coolant conduit;

means for thermally insulating said canister; and said cavity containing a quantity of phase change material having a melting point greater than 100° F.

2. An Engine Heating Device for use with an internal combustion engine having an exhaust system, coolant system and lubrication system, the device being used to warm the engine prior to starting and comprising:

a fluid-tight elongated canister having first and second ends and a cavity therein;

an exhaust gas conduit having an inlet end and an outlet end for carrying exhaust gasses during engine operation passing through said cavity of said canister from said first end to said second end, said conduit being connectable to said exhaust system;

means for thermally isolating said exhaust conduit from said exhaust system when exhaust gasses are not flowing;

means for thermally insulating said canister;

an intermediate fluid conduit having an inlet and an outlet, said intermediate fluid conduit passing through said cavity, said cavity containing a quantity of phase change material having a melting point greater than 100° F.;

means for isolating said intermediate fluid conduit;

an intermediate heat exchanger having a lubricating fluid side and an intermediate fluid side, said lubricating fluid side being connectable to said engine lubricant system and said intermediate fluid side being connected in circulating relationship with said intermediate fluid conduit;

means for circulating said lubricant through said lubricant conduit;

an intermediate fluid in said intermediate fluid conduit; and means for circulating said intermediate fluid.

3. The Engine Heating Device of claim 1 or 2 wherein said exhaust gas conduit is located adjacent the bottom of said canister.

4. The Engine Heating Device of claim 1 wherein said cooling fluid conduit is located adjacent the top of said canister.

5. The Engine Heating Device of claim 4 wherein said cooling fluid conduit has a plurality of heat-transfer fins attached thereto.

6. The Engine Heating Device of claim 5 further comprising a plurality of heat transfer fins attached to the exterior of said exhaust conduit.

7. The Engine Heating Device of claim 6 further comprising a plurality of heat transfer fins attached to the interior of said exhaust conduit.

8. The Engine Heating Device of claim 1 or 2 wherein said phase change material is a eutectic salt mixture.

9. The Engine Heating Device of claim 8 wherein said phase change material is a mixture of lithium hydroxide and potassium hydroxide.

10. The Engine Heating Device of claim 1 or 2 wherein said phase change material is a salt.

11. The Engine Heating Device of claim 10 wherein said salt is lithium nitrate.

12. The Engine Heating Device of claim 2 wherein said intermediate fluid is said engine coolant.

* * * * *

UNITED STATES PATENT AND TRADEMARK OFFICE

CERTIFICATE OF CORRECTION

PATENT NO. : 4,258,677

DATED : March 31, 1981

INVENTOR(S) : Nicholas A. Sanders

It is certified that error appears in the above-identified patent and that said Letters Patent are hereby corrected as shown below:

Column 5, claim 1, line 4, Delete "the" and substitute --and--.

Signed and Sealed this

*Fifteenth* Day of *September 1981*

[SEAL]

*Attest:*

GERALD J. MOSSINGHOFF

*Attesting Officer*

*Commissioner of Patents and Trademarks*